US008164980B2

(12) United States Patent
Sullivan et al.

(10) Patent No.: US 8,164,980 B2
(45) Date of Patent: Apr. 24, 2012

(54) METHODS AND APPARATUSES FOR DATA COLLECTION AND COMMUNICATION IN DRILL STRING COMPONENTS

(75) Inventors: Eric C. Sullivan, Houston, TX (US); Paul E. Pastusek, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 783 days.

(21) Appl. No.: 12/254,548

(22) Filed: Oct. 20, 2008

(65) Prior Publication Data

US 2010/0097890 A1 Apr. 22, 2010

(51) Int. Cl.
*E21B 47/12* (2012.01)
*E21B 47/16* (2006.01)

(52) U.S. Cl. ..... 367/82; 340/854.3; 340/854.4

(58) Field of Classification Search ..... 367/81–82; 340/854.3–854.5

See application file for complete search history.

(56) References Cited

U.S. PATENT DOCUMENTS

| | | | |
|---|---|---|---|
| 4,884,071 | A | 11/1989 | Howard |
| 6,208,586 | B1 | 3/2001 | Rorden et al. |
| 6,392,317 | B1 | 5/2002 | Hall et al. |
| 6,400,646 | B1 | 6/2002 | Shah et al. |
| 6,405,795 | B2 | 6/2002 | Holbert et al. |
| 6,641,434 | B2 | 11/2003 | Boyle et al. |
| 6,817,425 | B2 | 11/2004 | Schultz et al. |
| 6,866,306 | B2 | 3/2005 | Boyle et al. |
| 7,017,662 | B2 | 3/2006 | Schultz et al. |
| 7,064,676 | B2 | 6/2006 | Hall et al. |
| 7,168,506 | B2 | 1/2007 | Boucher et al. |
| 7,173,542 | B2 | 2/2007 | Beique et al. |
| 7,190,280 | B2 | 3/2007 | Hall et al. |
| 7,198,118 | B2 | 4/2007 | Hall et al. |
| 7,224,288 | B2 | 5/2007 | Hall et al. |
| 7,336,199 | B2 | 2/2008 | Lasater et al. |
| 2002/0140572 | A1 | 10/2002 | Gardner et al. |
| 2005/0035876 | A1 | 2/2005 | Hall et al. |
| 2005/0200498 | A1 * | 9/2005 | Gleitman ..... 340/854.4 |
| 2006/0065440 | A1 | 3/2006 | Hutchinson |
| 2006/0212224 | A1 | 9/2006 | Jogi et al. |
| 2006/0221768 | A1 * | 10/2006 | Hall et al. ..... 367/82 |
| 2006/0260797 | A1 * | 11/2006 | Hall et al. ..... 166/65.1 |
| 2006/0272859 | A1 | 12/2006 | Pastusek et al. |

(Continued)

OTHER PUBLICATIONS

International Search Report for International Application No. PCT/US2009/061233 mailed May 1, 2010, 4 pages.

(Continued)

*Primary Examiner* — Giovanna Wright
(74) *Attorney, Agent, or Firm* — Cantor Colburn LLP

(57) ABSTRACT

A drill string component includes a box-end and a pin-end. Each end includes a signal transceiver, which are operably coupled together. Each signal transceiver communicates with another signal transceiver in another component to form a communication network in the drillstring. An end-cap may be placed in the central bore of the pin-end of a component to form an annular chamber between a side of the end-cap and a wall of the central bore of the pin-end when the end-cap is disposed in the central bore. In some embodiments, an electronics module may be placed in the annular chamber and configured to communicate with one of the signal transceivers. Accelerometer data, as well as other sensor data, at various locations along the drillstring may be sampled by the electronics module and communicated to a remote computer. Drillstring motion dynamics, such as vibration, may be determined based on the accelerometer data.

28 Claims, 10 Drawing Sheets

U.S. PATENT DOCUMENTS

| | | | |
|---|---|---|---|
| 2007/0177461 | A1 | 8/2007 | Marsh |
| 2007/0188344 | A1 | 8/2007 | Hache et al. |
| 2008/0000688 | A1 | 1/2008 | McLoughlin et al. |
| 2008/0007424 | A1 | 1/2008 | Hall |
| 2008/0053654 | A1 | 3/2008 | Ullah et al. |

OTHER PUBLICATIONS

International Written Opinion for International Application No. PCT/US2009/061233 mailed May 1, 2010, 4 pages.

* cited by examiner

METHODS AND APPARATUSES FOR DATA COLLECTION AND COMMUNICATION IN DRILL STRING COMPONENTS

FIELD OF THE INVENTION

The present invention relates generally to transmission of data within a wellbore and more particularly to methods and apparatuses for obtaining downhole data or measurements while drilling.

BACKGROUND OF THE INVENTION

In rotary drilling, a rock bit is threaded onto a lower end of a drillstring. The drillstring is lowered and rotated, causing the bit to disintegrate geological formations. The bit cuts a borehole somewhat larger than the drillstring, so an annulus is created between the walls of the borehole and the drill string. Section after section of drill pipe, or other drillstring tool, is added to the drillstring as new depths are reached.

During drilling, a fluid, often called "mud," is pumped downward through the drill pipe, through the drill bit, and up to the surface through the annulus, carrying cuttings from the borehole bottom to the surface.

It is often useful to detect borehole conditions, drill bit conditions, and drillstring conditions while drilling. However, much of the desired data is not easily collected or retrieved. An ideal method of data retrieval would not slow down or otherwise hinder ordinary drilling operations, or require excessive personnel or the special involvement of the drilling crew. In addition, data retrieved in near real time is generally of greater utility than data retrieved after a prolonged time delay.

Directional drilling is the process of using the drill bit to drill a borehole in a specific direction to achieve some drilling objective. Measurements concerning the drift angle, the azimuth, and tool face orientation all aid in directional drilling. A measurement while drilling system may replace single shot surveys and wire line steering tools, saving time and cutting drilling costs.

Measurement while drilling systems may also yield valuable information about the condition of the drill bit, helping determine when to replace a worn bit, thus avoiding the pulling of bits that are not near their end of life or drilling until a bit fails.

Other valuable information may be gathered by formation evaluation within a measurement while drilling system. Gamma ray logs, formation resistivity logs, and formation pressure measurements are helpful in determining the necessity of liners, reducing the risk of blowouts, allowing the safe use of lower mud weights for more rapid drilling, reducing the risks of lost circulation, and reducing the risks of differential sticking.

Existing measurement while drilling systems are said to improve drilling efficiency. However, problems still remain with the transmission of subsurface data from subsurface sensors to surface monitoring equipment, while drilling operations continue. A variety of data transmission systems have been proposed or attempted, but the search for new and improved systems for data transmission continues. Such attempts and proposals include the transmission of signals through cables in the drill string, or through cables suspended in the bore hole of the drill string; the transmission of signals by electromagnetic waves through the earth; the transmission of signals by acoustic or seismic waves through the drill pipe, the earth, or the mud stream; the transmission of signals by way of releasing chemical or radioactive tracers in the mud stream; the storing of signals in a downhole recorder, with periodic or continuous retrieval; and the transmission of data signals over pressure pulses in the mud stream.

Drilling fluid telemetry in the form of continuous wave and mud pulse telemetry presents a number of challenges. As examples, mud telemetry has a slow data transmission rate, high signal attenuation, difficulty in detecting signals over mud pump noise, maintenance requirements, and the inconvenience of interfacing and matching the data telemetry system with the choice of mud pump, and drill bit.

Electrical telemetry using electrical conductors in the transmission of subsurface data also presents an array of unique problems. One significant difficulty is making a reliable electrical connection at each pipe junction. Communication systems using direct electrical connection between drill pipes have been proposed. In addition, communication systems using inductive coupling and Hall Effect coupling at drill pipe joints have been proposed.

With the ever-increasing need for downhole drilling system dynamic data, a number of "subs" (i.e., a sub-assembly incorporated into the drill string above the drill bit and used to collect data relating to drilling and drillstring parameters) have been designed and installed in drillstrings. For data transmission systems to operate to full advantage, it is desirable that drill string components, such as drill bits and sensor subassemblies, be produced to cooperate therewith. Drillstring components so configured could provide significant amounts of useful data. Unfortunately, such conventional subs are expensive and are configured as dedicated downhole components that must be placed in the drillstring instead of, or in addition to, a simple drill pipe or drill collar.

There is a need for new methods and apparatuses for distributing data processing modules along a drillstring and providing communication between these data processing modules and a remote computer. In addition, there is a need for methods and apparatuses for analyzing dynamic movements of the drillstring.

BRIEF SUMMARY OF THE INVENTION

Embodiments of the present invention include methods and apparatuses for disposing data processing modules in drillstring elements and providing communication between these data processing modules disposed along a drillstring and a remote computer. In addition, embodiments of the present invention include methods and apparatuses for analyzing dynamic movements of the drillstring.

One embodiment of the invention includes a component configured for attachment as part of a drillstring. The component includes a tubular member with a central bore formed therethrough. At a first end of the tubular member is a box-end. At a second end of the tubular member is a pin-end adapted for coupling to a box-end of another downhole tool. The box-end includes a first signal transceiver and the pin-end and includes a second signal transceiver operably coupled to the first signal transceiver and also configured for communication with the first signal transceiver in another component of the drillstring. An end-cap is configured for disposition in the central bore of the pin-end to form an annular chamber between a side of the end-cap and a wall of the central bore of the pin-end when the end-cap is disposed in the central bore of the pin-end. In some embodiments, an electronics module is configured for disposition in the annular chamber and configured to communicate with the second signal transceiver.

Another embodiment of the invention includes a drillstring communication network comprising a plurality of components including downhole tools, subs, joints, drill collars, and other components coupled together. Each component includes a box-end at a first end of the component bearing a first signal transceiver and a pin-end at a second end of the component bearing a second signal transceiver. Some, or all, of the components include an end-cap disposed in a central bore of the pin-end forming an annular chamber between a side of the end-cap and a wall of the central bore of the pin-end. In addition, some, or all, of the components include an electronics module disposed in the annular chamber. The electronics module includes at least one sensor and a communication element operably coupled between the at least one sensor and the second signal transceiver. A remote computer is configured for communicating with the components that include an electronics module. The first signal transceiver of each component and the second signal transceiver of each component are configured for communication therebetween such that the components form a communication link between the communication elements of the components including electronics modules and the remote computer.

Another embodiment of the invention includes a drillstring dynamics analysis network. The network includes a plurality of data processing modules disposed in a plurality of components coupled to form a drillstring. The plurality of data processing modules are operably coupled for communication therebetween and communication with a remote computer. Each data processing module includes a plurality of accelerometers configured for sensing acceleration in a plurality of directions at the data processing module and a communication element operably coupled to the plurality of accelerometers. The communication element is also coupled to at least one other data processing module. Each data processing module is configured to collect accelerometer information at substantially the same time as other data processing modules and transmit the accelerometer information to the at least one communication element in another data processing module, the remote computer, or a combination thereof.

Yet another embodiment of the invention includes a method of communicating information in a drillstring. The method includes communicatively coupling a plurality of components bearing a first transceiver at a box-end and a second transceiver at a pin-end by mechanically coupling the plurality of components to form a drillstring communication network. The method also includes disposing at least one electronics module in an annular chamber of the pin-end of at least one component of the plurality to operably couple the at least one electronics module to the drillstring communication network. At least one physical parameter is sensed near the at least one electronics module and communicated to another electronics module in another component, a remote computer, or a combination thereof.

Yet another embodiment of the invention includes a method of determining dynamics characteristics of a drillstring. The method includes acquiring accelerometer information at a plurality of locations along a drillstring by sampling a plurality of accelerometers disposed in a pin-end of a plurality of drillstring tools operably coupled together to form the drillstring. The method also includes communicating the accelerometer information along the drillstring using communication capabilities of each drillstring tool in the drillstring and processing the accelerometer information from the plurality of locations to determine drillstring dynamics information about the drillstring.

DETAILED DESCRIPTION OF THE INVENTION

Figure 1:
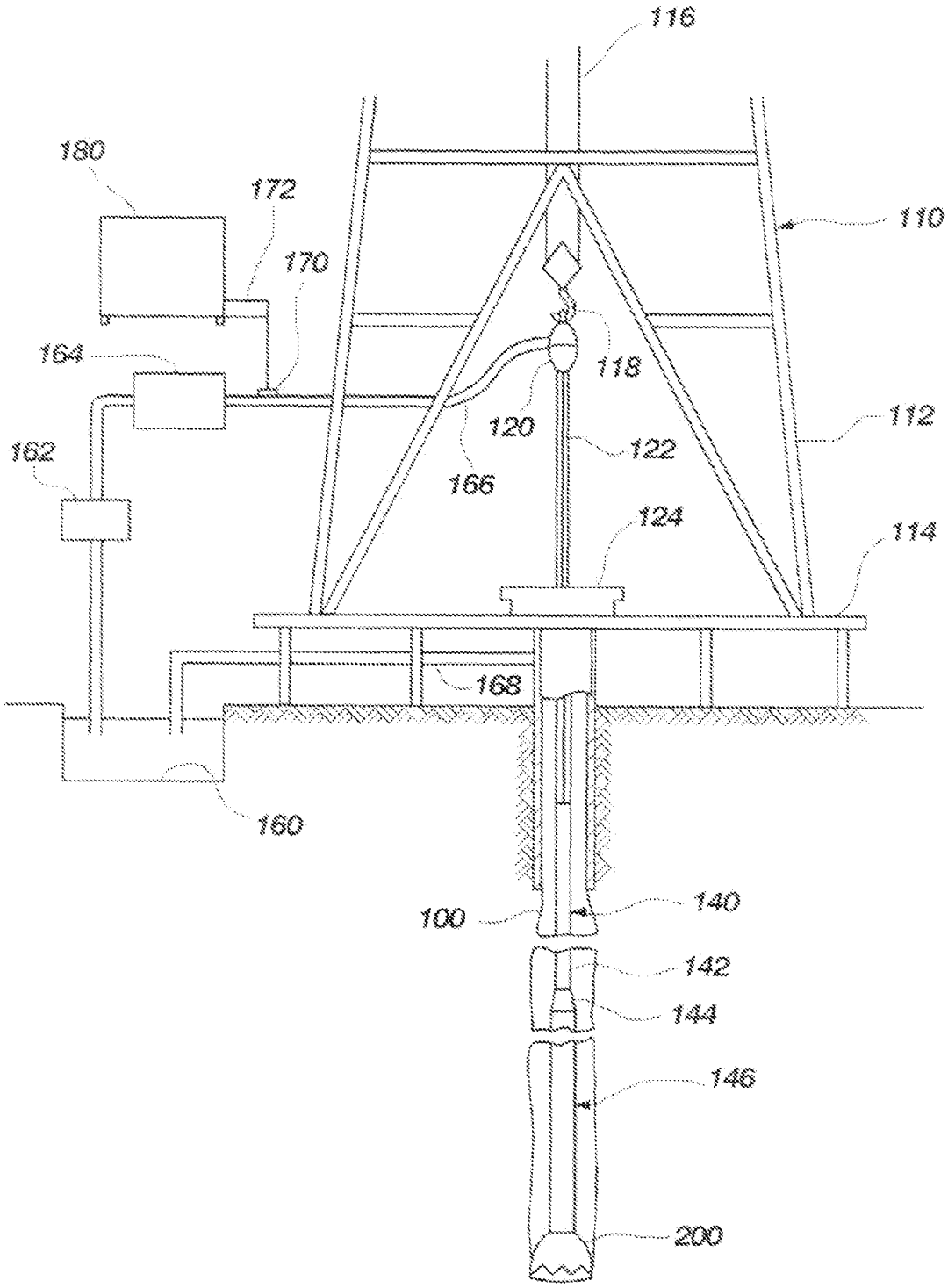
FIG. 1 (prior art)
FIG. 1 illustrates a conventional drilling rig for performing drilling operations.

FIG. 1 depicts an example of a conventional apparatus for performing subterranean drilling operations. Drilling rig 110 includes a derrick 112, a derrick floor 114, a draw works 116, a hook 118, a swivel 120, a Kelly joint 122, and a rotary table 124. A drillstring 140, which includes a drill pipe section 142 and a drill collar section 144, extends downward from the drilling rig 110 into a borehole 100. The drill pipe section 142 may include a number of tubular drill pipe members or strands connected together and the drill collar section 144 may likewise include a plurality of drill collars. In addition, the drillstring 140 may include a measurement-while-drilling (MWD) logging subassembly and cooperating mud pulse telemetry data transmission subassembly, which are collectively referred to as an MWD communication system 146, as well as other communication systems known to those of ordinary skill in the art.

During drilling operations, drilling fluid is circulated from a mud pit 160 through a mud pump 162, through a desurger 164, and through a mud supply line 166 into the swivel 120. The drilling mud (also referred to as drilling fluid) flows through the Kelly joint 122 and into an axial central bore in the drillstring 140. Eventually, it exits through apertures or nozzles, which are located in a drill bit 200, which is connected to the lowermost portion of the drillstring 140 below drill collar section 144. The drilling mud flows back up through an annular space between the outer surface of the drillstring 140 and the inner surface of the borehole 100, to be circulated to the surface where it is returned to the mud pit 160 through a mud return line 168.

A shaker screen (not shown) may be used to separate formation cuttings from the drilling mud before it returns to the mud pit 160. The MWD communication system 146 may utilize a mud pulse telemetry technique to communicate data from a downhole location to the surface while drilling operations take place. To receive data at the surface, a mud pulse transducer 170 is provided in communication with the mud supply line 166. This mud pulse transducer 170 generates electrical signals in response to pressure variations of the drilling mud in the mud supply line 166. These electrical signals are transmitted by a surface conductor 172 to a surface electronic processing system 180, which is conventionally a data processing system with a central processing unit for executing program instructions, and for responding to user commands entered through either a keyboard or a graphical pointing device. The mud pulse telemetry system is provided for communicating data to the surface concerning numerous downhole conditions sensed by well logging and measurement systems that are conventionally located within the MWD communication system 146. Mud pulses that define the data propagated to the surface are produced by equipment conventionally located within the MWD communication system 146. Such equipment typically comprises a pressure pulse generator operating under control of electronics contained in an instrument housing to allow drilling mud to vent through an orifice extending through the drill collar wall. Each time the pressure pulse generator causes such venting, a negative pressure pulse is transmitted to be received by the mud pulse transducer 170. An alternative conventional arrangement generates and transmits positive pressure pulses. As is conventional, the circulating drilling mud also may provide a source of energy for a turbine-driven generator subassembly (not shown) which may be located near a bottom hole assembly (BHA). The turbine-driven generator may generate electrical power for the pressure pulse generator and for various circuits including those circuits that form the operational components of the measurement-while-drilling tools. As an alternative or supplemental source of electrical power, batteries may be provided, particularly as a back up for the turbine-driven generator.

Embodiments of the present invention include methods and apparatuses for disposing data processing modules in drillstring elements and providing communication between these data processing modules disposed along a drillstring and a remote computer. In addition, embodiments of the present invention include methods and apparatuses for analyzing dynamic movements of the drillstring.

As used in this specification, the term "downhole" is intended to have a relatively broad meaning. Downhole includes environments within a wellbore and below the surface, such as, environments encountered when drilling for oil and/or gas, and extraction of other subterranean minerals, as well as when drilling for water and other subsurface liquids, and for geothermal exploration.

The term "component" refers to any pipe, collar, joint, sub or other component having a central bore and used in exploration and/or excavation of a subterranean well. Non-limiting examples of such components include casings, drill pipe, drill collars, drill bit subs, transmission links, reamers, stabilizers, motors, turbines, mud hammers, jars, Kellys, blow-out preventers, and steering subs.

Figure 2:
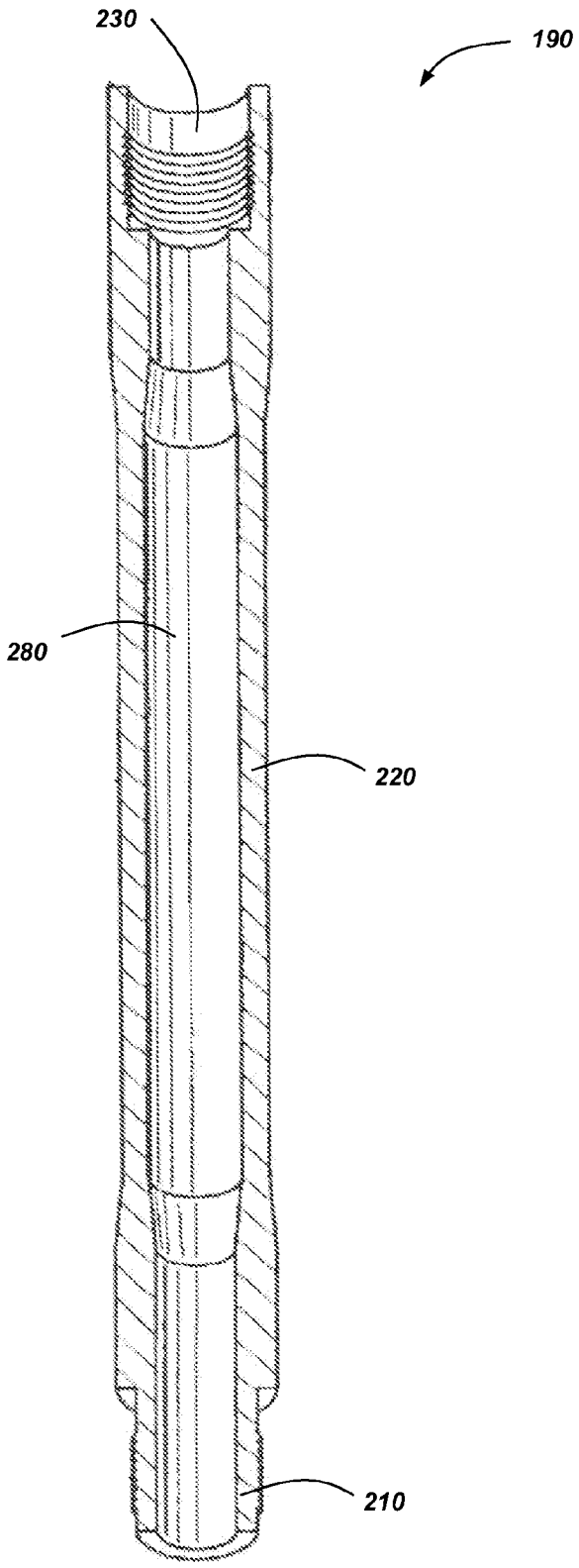
FIG. 2 illustrates a drill pipe as an example of a component including one or more embodiments of the present invention.

FIG. 2 is a perspective view of a drill pipe 190 as an example of a component 190 including one or more embodiments of the present invention. The component 190 may include a substantially cylindrical tubular member 220 between a box-end 230 (also referred to herein as a first end 230) and a pin-end 210 (also referred to herein as a second end 210). In general, such components 190 have a central passageway 280 (i.e., a central bore 280) to permit the flow of drilling fluid from the surface to the drill bit. Although the component 190 is illustrated as a section of drill pipe, its purpose is to generally represent the relevant characteristics of all components 190. As a non-limiting example, heavy weight drill pipe and drill collars may differ from the drill pipe of FIG. 2 in the thickness of the outer wall. Similarly, a reamer, used to enlarge the gage of the borehole above a bit of smaller diameter, and a stabilizer, used to ride against the bore wall to give stability to the drill string, may be similar to the drill pipe of FIG. 2 with fixed or moveable bearing and cutting surfaces protruding from the outer wall surface of the body. Furthermore, some components 190, like jars, motors, hammers, steering subs, sensor subs, and blow-out preventers, may include additional internal elements in the basic component structure of FIG. 2 to achieve unique functions related to borehole exploration and/or excavation.

Certain shared functional characteristics are used in order to enable components 190 to join together in series to form a drill string. By way of example and not limitation, the pin-end 210 includes external tapered threads. Conversely, the box-end 230 includes internal tapered threads. The tubular member 220 extends between the box-end 230 and the pin-end 210 and may extend between about thirty and ninety feet in length. The pin-end 210 and the box-end 230 are complementary, such that a pin-end 210 of a first component may be joined to box-end 230 a second component. In this manner, components 190 may be joined together to form a drill string 140 as long as 20,000 feet or more.

Figure 3:
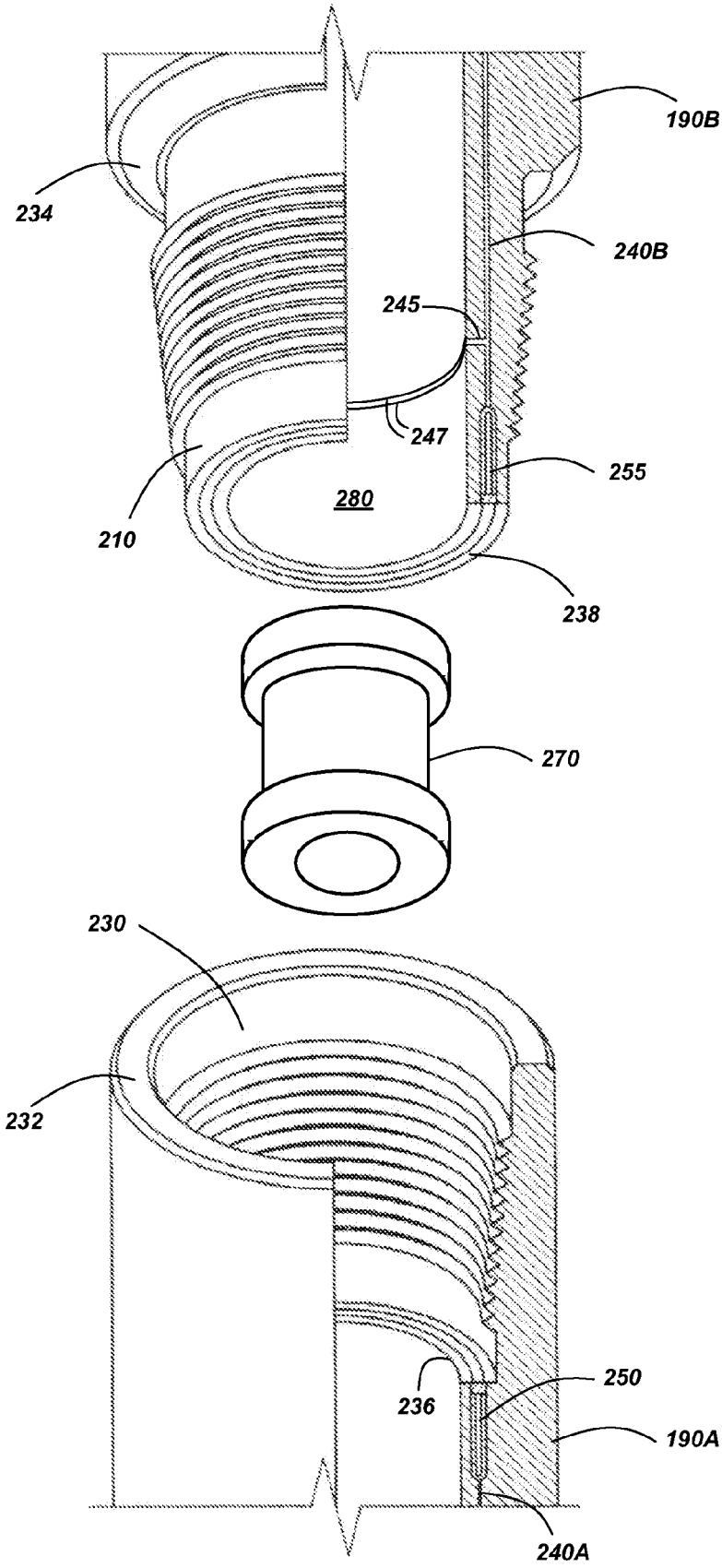
FIG. 3 is a perspective view showing a pin-end of one component, a box-end of another component, and an end-cap for disposition in the pin-end.

FIG. 3 is a perspective views showing a box-end 230 of a first downhole tool, a pin-end 210 of a second downhole tool, and an end-cap 270 for disposition in the pin-end 210. In some embodiments, an electronics module (not illustrated in FIG. 3) may be disposed around the end-cap 270 such that the end-cap 270 and electronics module can be secured within the borehole of the pin-end 210. When two components (190A and 190B) are connected the pin-end 210 on the second component is threaded into the box-end 230 on the first component such that surfaces 232 and 234 engage to form a tight connection between the first component and the second component.

A first signal transceiver 250 is illustrated as embedded in a ring around an interior surface 236 of the box-end 230 of the first component 190A. Similarly, a second signal transceiver 255 is embedded in a ring around the outer surface 238 of the pin-end 210 of the second component 190B. When the two components (190A and 190B) are coupled together, the first signal transceiver 250 and the second signal transceiver 255 are disposed opposite each other and substantially close together.

Communication between the first signal transceiver 250 and the second signal transceiver 255 may be implemented in a variety of ways. In FIG. 3, as a non-limiting example, the first signal transceiver 250 and the second signal transceiver 255 include wire coils embedded in annular channels in the interior surface 236 and outer surface 238, respectively. Thus, the first signal transceiver 250 and the second signal transceiver 255 form an intra-tool coupling signal via inductive coupling therebetween.

As another non-limiting example, signals may be transmitted between the first signal transceiver 250 and the second signal transceiver 255 by way of Hall Effect coupling as depicted, described, and claimed in U.S. Pat. No. 4,884,071 entitled "Wellbore Tool With Hall Effect Coupling," which issued on Nov. 28, 1989 to Howard, the disclosure of which is incorporated herein by reference.

An electrical pathway (240A and 240B) is illustrated as a small borehole in the sidewall of the components (190A and 190B) extends between the box-end 230 and the pin-end 210. However, other electrical pathways are possible. As a non-limiting example, the electrical pathway may be configured as a conduit running along the inside surface of the central bore 280 between the box-end 230 and the pin-end 210.

The first signal transceiver 250 and the second signal transceiver 255 within the same component may be coupled for communication as an inter-tool coupling signal inside the electrical pathway 240 in a number of ways. As non-limiting examples, a coaxial cable, twisted pair wires, individual wires, or combinations thereof may be used to couple the first signal transceiver 250 and the second signal transceiver 255 for communication. In addition to signals, the wires or cables may be used for transmitting power to electronics modules along the drillstring. Alternatively, some or all of the electronics modules may include their own independent power source.

With the first signal transceiver 250 and second signal transceiver 255 coupled together in each drillstring tool, and the drillstring tools coupled through inductive coupling, Hall effect coupling, or other suitable communicative coupling, the drillstring tools are all coupled together to form a drillstring communication network.

Each drillstring tool need not include an end-cap 270 or an electronics module (not shown) disposed around the end-cap 270. However, to form a continuous drillstring communication network, each drillstring tool between the surface and the farthest component with a communication element will include a first signal transceiver 250 coupled to a second signal transceiver 255 such that the drillstring forms the continuous network. The communication network may extend partially down the drillstring or may extend all the way to, and including, the drill bit.

A connection pathway 245 extends from the electrical pathway 240 to the central bore 280. This connection pathway 245 enables coupling of the electronics module (not shown in FIG. 3) disposed around the end-cap 270 to connect with the wires or cables in the electrical pathway 240, thus forming a connection to the drillstring communication network. As a non-limiting example, the connection pathway 245 may include electrical connections 247 (or other suitable communication link) around the central bore 280. In this way, the electronics module may include contact points (not shown) that connect with the electrical connections 247 when the electronics module is disposed in the central bore 280. Of course, the number of communication link signals may vary for different embodiments of the invention.

Figure 4:
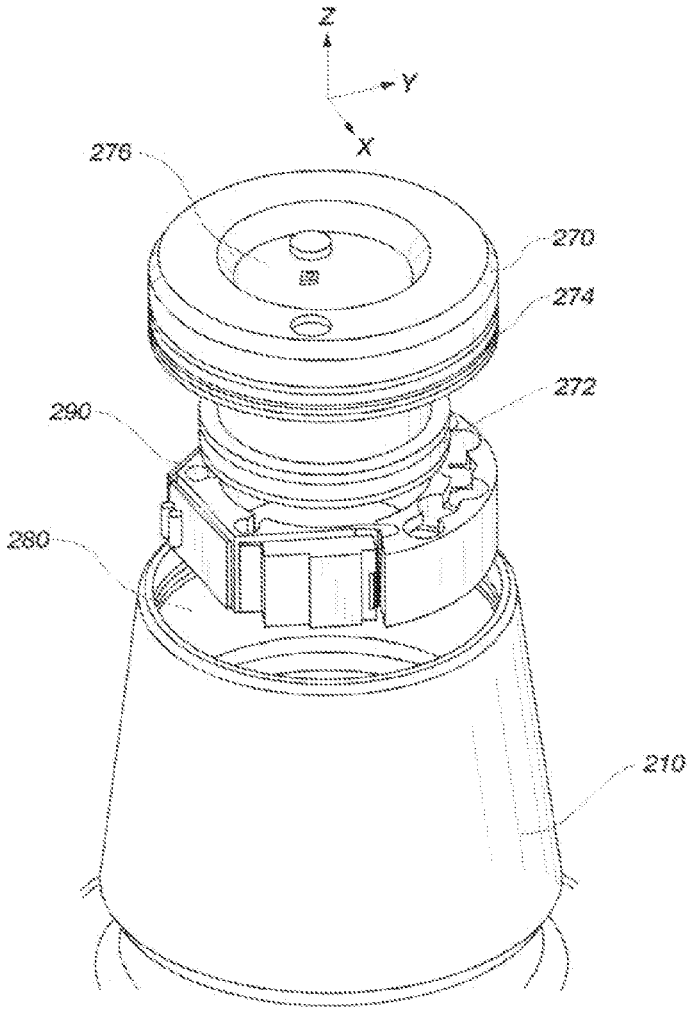
FIG. 4 is a perspective view of a pin-end, receiving an embodiment of an electronics module and an end-cap.
Figure 5:
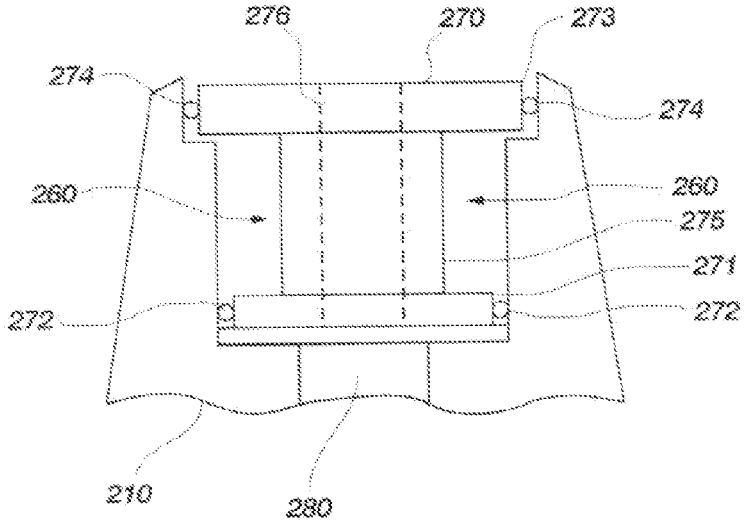
FIG. 5 is a cross sectional view of the pin-end with the end-cap disposed therein.
Figure 6:
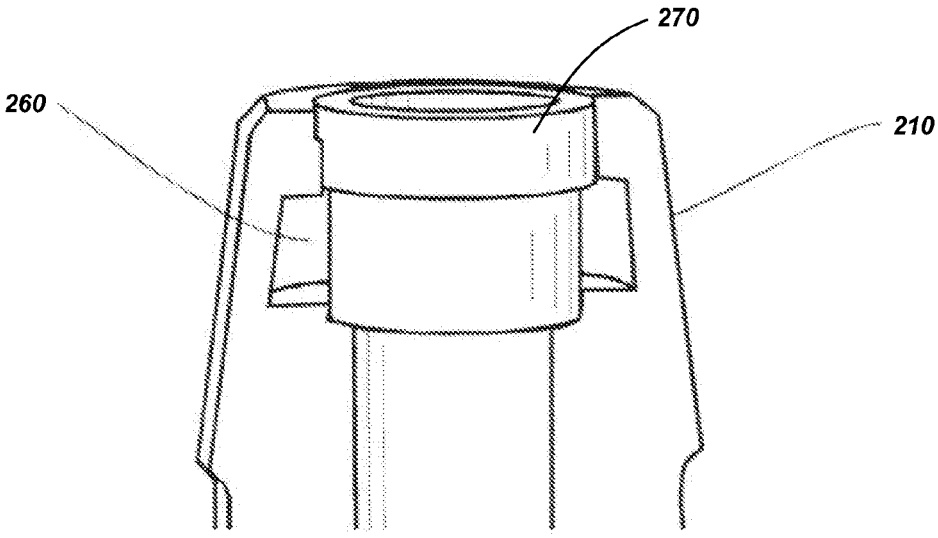
FIG. 6 is another cross sectional view of the pin-end with the end-cap disposed therein and illustrating an annular chamber formed by the end-cap and borehole through the pin-end.

FIG. 4 is a perspective view of a pin-end 210, receiving an embodiment of an electronics module and an end-cap 270 according to one or more embodiments of the present invention. FIG. 5 is a cross sectional view of the pin-end 210 with the end-cap 270 disposed therein. FIG. 6 is a cross sectional view of another embodiment of a pin-end 210 with an end-cap 270 disposed therein, and an annular chamber 260 formed between the pin-end 210 and the end-cap 270. For clarity, the threads on the pin-end 210 are not illustrated in FIGS. 4, 5, and 6.

In the FIG. 6 embodiment, much of the annular chamber 260 is formed within the sidewall of the pin-end 210. In contrast, in the embodiment of FIGS. 4 and 5 much of the annular chamber 260 is formed by around the pin-end 210. In more detail, FIGS. 4 and 5 illustrate the pin-end 210 of a component, an end-cap 270, and an embodiment of an electronics module 290 (not shown in FIG. 5). The pin-end 210 includes a central bore 280 formed through the longitudinal axis of the pin-end 210. In conventional components 190, this central bore 280 is configured for allowing drilling mud to flow therethrough. In the present invention, at least a portion of the central bore 280 is given a diameter sufficient for accepting the electronics module 290 configured in a substantially annular ring, yet without substantially affecting the structural integrity of the pin-end 210. Thus, the electronics module 290 may be placed down in the central bore 280, about the end-cap 270, which extends through the inside diameter of the annular ring of the electronics module 290 to create a fluid tight annular chamber 260 (FIG. 5) with the wall of the central bore 280 and seal the electronics module 290 in place within the pin-end 210.

The end-cap 270 includes a cap bore 276 formed therethrough, such that the drilling mud may flow through the end cap, through the central bore 280 of the pin-end 210 to the other side of the pin-end 210, and then into the body of component 190. In addition, the end-cap 270 includes a first flange 271 including a first sealing ring 272, near the lower end of the end-cap 270, and a second flange 273 including a second sealing ring 274, near the upper end of the end-cap 270.

FIG. 5 is a cross-sectional view of the end-cap 270 disposed in the pin-end 210 without the electronics module 290 (FIG. 7), illustrating the annular chamber 260 formed between the first flange 271, the second flange 273, the end-cap body 275, and the walls of the central bore 280. The first sealing ring 272 and the second sealing ring 274 form a protective, fluid tight, seal between the end-cap 270 and the wall of the central bore 280 to protect the electronics module 290 (FIG. 7) from adverse environmental conditions. The protective seal formed by the first sealing ring 272 and the second sealing ring 274 may also be configured to maintain the annular chamber 260 at approximately atmospheric pressure.

In the embodiment shown in FIGS. 4 and 5, the first sealing ring 272 and the second sealing ring 274 are formed of material suitable for high-pressure, high temperature environment, such as, for example, a Hydrogenated Nitrile Butadiene Rubber (HNBR) O-ring in combination with a PEEK back-up ring. In addition, the end-cap 270 may be secured to the pin-end 210 with a number of connection mechanisms such as, for example, a secure press-fit using sealing rings 272 and 274, a threaded connection, an epoxy connection, a shape-memory retainer, welded, and brazed. It will be recognized by those of ordinary skill in the art that the end-cap 270 may be held in place quite firmly by a relatively simple connection mechanism due to differential pressure and downward mud-flow during drilling operations.

Figure 7:
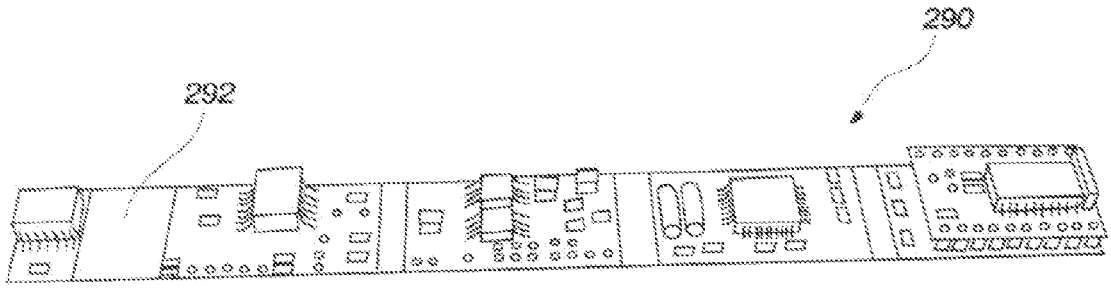
FIG. 7 is a drawing of an embodiment of an electronics module configured as a flex-circuit board enabling formation into an annular ring suitable for disposition in the annular chamber of FIGS. 5 and 6.

FIG. 7 is a drawing of an embodiment of the electronics module 290 configured as a flex-circuit board enabling formation into an annular ring suitable for disposition in the annular chamber 260 of FIGS. 4, 5, and 6. This flex-circuit board embodiment of the electronics module 290 is shown in a flat uncurled configuration in FIG. 7. The flex-circuit board 292 includes a high-strength reinforced backbone (not shown) to provide acceptable transmissibility of acceleration effects to sensors such as accelerometers. In addition, other areas of the flex-circuit board 292 bearing non-sensor electronic components may be attached to the end-cap 270 in a manner suitable for at least partially attenuating the acceleration effects experienced by the component 190 during drilling operations using a material such as a visco-elastic adhesive.

As used herein, electronics module 290 generally refers to a physical configuration of a circuit board including electrical components, electronic components, or combinations thereof configured for practicing embodiments of the present invention. Furthermore, as used herein, data processing module generally refers to a functional configuration of elements on the electronics module 290 configured to perform functions according to embodiments of the present invention.

A data processing module may be configured for sampling data in different sampling modes, sampling data at different sampling frequencies, and analyzing data. The data processing module may also be configured to communicate the sampled data, the analyzed data, software, firmware, control data, and combinations thereof to other data processing modules in other components 190, the drill bit, or a surface computer (not shown).

Figure 8:
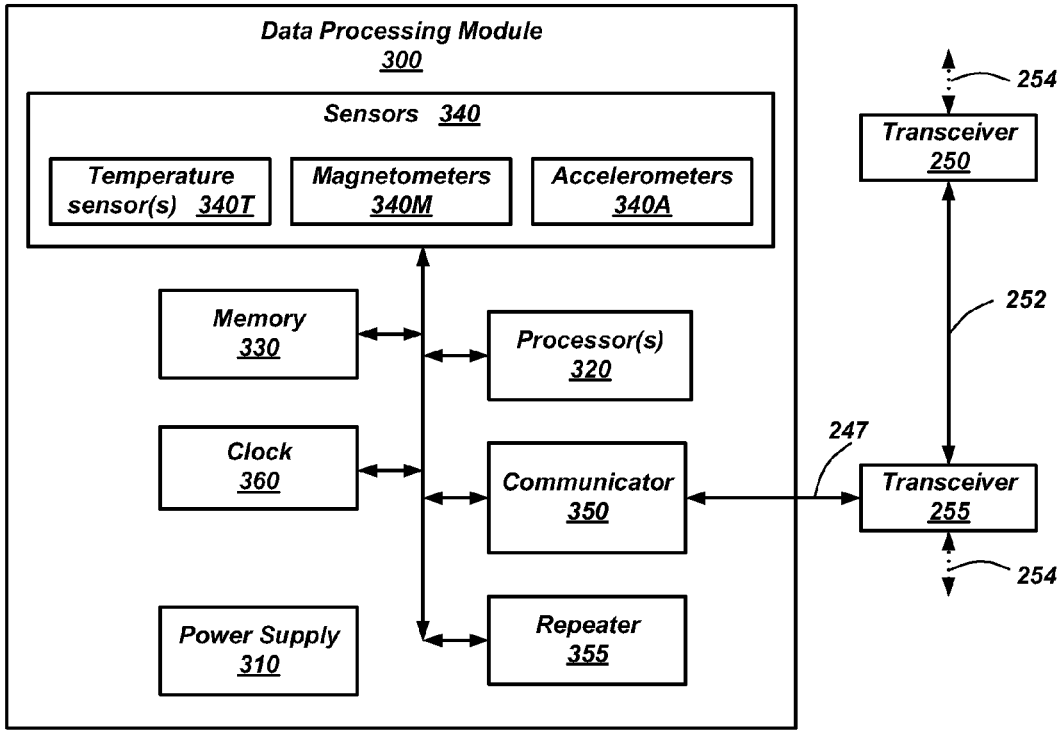
FIG. 8 is a block diagram of an embodiment of a data processing module according to one or more embodiments of the present invention.

An embodiment of a data processing module 300 is illustrated in FIG. 8. The data processing module 300 includes a power supply 310, one or more processors 320, a memory 330, and a clock 360. The data processing module 300 may also include one or more sensors 340 configured for measuring a plurality of physical parameter related to a component state, which may include component condition, drilling operation conditions, and environmental conditions proximate the component. In the embodiment of FIG. 8, the sensors 340 may include a plurality of accelerometers 340A, a plurality of magnetometers 340M, and at least one temperature sensor 340T.

The plurality of accelerometers 340A may include three accelerometers 340A configured in a Cartesian coordinate arrangement. Similarly, the plurality of magnetometers 340M may include three magnetometers 340M configured in a Cartesian coordinate arrangement. While any coordinate system may be defined within the scope of the present invention, one example of a Cartesian coordinate system, shown in FIG. 4, defines a z-axis along the longitudinal axis about which the drill bit 200 rotates, an x-axis perpendicular to the z-axis, and a y-axis perpendicular to both the z-axis and the x-axis, to form the three orthogonal axes of a typical Cartesian coordinate system. Because the data processing module 300 may be used while the component 190 is rotating and with the component 190 in other than vertical orientations, the coordinate system may be considered a rotating Cartesian coordinate system with a varying orientation relative to the fixed surface location of the drilling rig 110 (FIG. 1).

The accelerometers 340A of the FIG. 8 embodiment, when enabled and sampled, provide a measure of acceleration of the component 190 along at least one of the three orthogonal axes. The data processing module 300 may include additional accelerometers 340A to provide a redundant system, wherein various accelerometers 340A may be selected, or deselected, in response to fault diagnostics performed by the processor 320. Furthermore, additional accelerometers 340A may be used to determine additional information about bit dynamics and assist in distinguishing lateral accelerations from angular accelerations.

Figure 9:
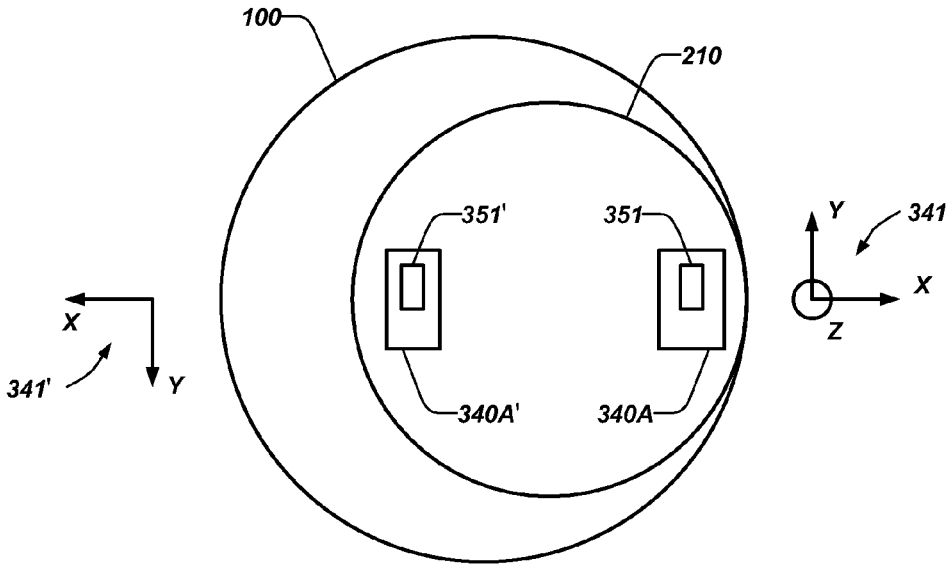
FIG. 9 illustrates placement of multiple accelerometers in a component relative to a borehole.

FIG. 9 is a top view of a component within a borehole. As can be seen, FIG. 9 illustrates the component 190 offset within the borehole 100, which may occur due to drillstring behavior other than simple rotation around a rotational axis. FIG. 9 also illustrates placement of multiple accelerometers with a first set of accelerometers 340A positioned at a first location and a second set of accelerometers 340A' positioned at a second location within the bit body. By way of example, the first set 340A includes a first coordinate system 341 with x, y, and z accelerometers, while the second set 340A' includes a second coordinate system with x and y accelerometers 341'. For example only, an x accelerometer may be configured to detect and measure a tangential acceleration of drill bit 200, a y accelerometer may be configured to detect and measure a radial acceleration of drill bit 200, and a z accelerometer may be configured to detect and measure an axial acceleration of drill bit 200. As a non-limiting example, first set 340A and second set 340A' may comprise accelerometers rated for 30 g acceleration. Furthermore, first set of accelerometers 340A and second set of accelerometers 340A' may each include an additional x accelerometer 351 located with the first set of accelerometers 340A and an additional x accelerometer 351' located with the second set of accelerometers 340A'. These additional x accelerometers (351 and 351') may be configured to detect and measure lower accelerations in a radial direction relative to the x accelerometers in the first set of accelerometers 340A and the second set of accelerometers 340A'. As a non-limiting example only, the additional x accelerometer (351 and 351') may comprise accelerometers rated for 5 g accelerations and x accelerometers in the first set 340A and the second 340A' may comprise accelerometers rated for 30 g accelerations. As such, the second x accelerometers may provide enhanced granularity and, thus, enhanced precision in revolutions per minute (RPM) calculations.

For example, in high motion situations, the first set 340A and the second 340A' of accelerometers provide a large range of accelerations (i.e., up to 30 g). In lower motion situations, x accelerometers 351 and 351' provide more precision, of the acceleration at these lower accelerations. As a result, more precise calculations may be performed when deriving dynamic behavior at low accelerations.

Of course, other embodiments may include three coordinates in the second set of accelerometers as well as other configurations and orientations of accelerometers alone or in multiple coordinate sets. With the placement of a second set of accelerometers at a different location on the drill bit, differences between the accelerometer sets may be used to distinguish lateral accelerations from angular accelerations. For example, if the two sets of accelerometers are both placed at the same radius from the rotational center of the component and the component is only rotating about that rotational center, then the two accelerometer sets will experience the same angular rotation. However, the bit may be experiencing more complex behavior, such as, for example, bit whirl, bit wobble, bit walking, and lateral vibration. These behaviors include some type of lateral motion in combination with the angular motion. For example, as illustrated in FIG. 9, the component may be rotating about its rotational axis and at the same time, walking around the larger circumference of the borehole 100. In these types of motion, the two sets of accelerometers disposed at different places will experience different accelerations. With the appropriate signal processing and mathematical analysis, the lateral accelerations and angular accelerations may be more easily determined with the additional accelerometers.

Furthermore, if initial conditions are known or estimated, component velocity profiles and component trajectories may be inferred by mathematical integration of the accelerometer data using conventional numerical analysis techniques. As is explained more fully below, acceleration data may be analyzed and used to determine adaptive thresholds to trigger specific events within the data processing module 300. Furthermore, if the acceleration data is integrated to obtain bit velocity profiles or bit trajectories, these additional data sets may be useful for determining additional adaptive thresholds through direct application of the data set or through additional processing, such as, for example, pattern recognition analysis. By way of example, and not limitation, an adaptive threshold may be set based on how far off center a component may traverse before triggering an event of interest within the data processing module 300. For example, if the component trajectory indicates that the component is offset from the center of the borehole by more than one inch, a different algorithm of data collection from the sensors 340 may be invoked.

The magnetometers 340M of the FIG. 8 embodiment, when enabled and sampled, provide a measure of the orientation of the component 200 along at least one of the three orthogonal axes relative to the earth's magnetic field. The data processing module 300 may include additional magnetometers 340M to provide a redundant system, wherein various magnetometers 340M may be selected, or deselected, in response to fault diagnostics performed by the processor 320.

The data processing module 300 may be configured to provide for recalibration of magnetometers 340M during operation. Recalibration of magnetometers 340M may be necessary to remove magnetic field affects caused by the environment in which the magnetometers 340M reside. For example, measurements taken in a downhole environment may include errors due to a high magnetic field within the downhole formation. Therefore, it may be advantageous to recalibrate the magnetometers 340M prior to taking new measurements in order to take into account the high magnetic field within the formation.

The temperature sensor 340T may be used to gather data relating to the temperature of the component, and the temperature near the accelerometers 340A, magnetometers 340M, and other sensors 340. Temperature data may be useful for calibrating the accelerometers 340A and magnetometers 340M to be more accurate at a variety of temperatures.

Other optional sensors 340 (not shown) may be included as part of the data processing module 300. Some non-limiting examples of sensors 340 that may be useful in the present invention are strain sensors at various locations of the component, temperature sensors at various locations of the component, mud (drilling fluid) pressure sensors to measure mud pressure internal to the component, and borehole pressure sensors to measure hydrostatic pressure external to the component. Sensors 340 may also be implemented to detect mud properties, such as, for example, sensors 340 to detect conductivity or impedance to both alternating current and direct current, sensors 340 to detect changes in mud properties, and sensors 340 to characterize mud properties such as synthetic based mud and water based mud. These optional sensors 340 may include sensors 340 that are integrated with and configured as part of the data processing module 300 or as optional remote sensors 340 placed in other areas of the component 200.

Returning to FIG. 8, the memory 330 may be used for storing sensor data, signal processing results, long-term data storage, and computer instructions for execution by the processor 320. Portions of the memory 330 may be located external to the processor 320 and portions may be located within the processor 320. The memory 330 may be Dynamic Random Access Memory (DRAM), Static Random Access Memory (SRAM), Read Only Memory (ROM), Nonvolatile Random Access Memory (NVRAM), such as Flash memory, Electrically Erasable Programmable ROM (EEPROM), or combinations thereof. In the FIG. 8 embodiment, the memory 330 is a combination of SRAM in the processor 320 (not shown), Flash memory 330 in the processor 320, and external Flash memory 330. Flash memory may be desirable for low power operation and ability to retain information when no power is applied to the memory 330.

The data processing module 300 also includes a communicator 350 (also referred to herein as a communication element 350) for coupling to the second signal transceiver 255 via communication link 247. As stated earlier, the second signal transceiver 255 is coupled to the first signal transceiver 250 by an inter-tool coupling signal 252. In addition, communication between the first signal transceiver 250 in one component and a second signal transceiver 255 in another component occurs via intra-tool coupling signals 254. The communicator 350 may use any suitable communications protocol and communication physical layer, which may depend on the type of inter-tool coupling signal 252 and intra-tool coupling signal 254 used in the component. As non-limiting examples, a wireless communication protocol may include Bluetooth, and 802.11a/b/g protocols. In addition, using the communicator 350, the data processing module 300 may be configured to communicate with a remote processing system (not shown) such as, for example, a computer, a portable computer, or a personal digital assistant (PDA) when the component is not downhole. Thus, the communication link 247 may be used for a variety of functions, such as, for example, to download software and software upgrades, to enable setup of the data processing module 300 by downloading configuration data, and to upload sample data and analysis data. The communicator 350 may also be used to query the data processing module 300 for information related to the component, such as, for example, data processing module serial number, software version, and other long term data that may be stored in the NVRAM.

The processor 320 in the embodiment of FIG. 8 may be configured for processing, analyzing, and storing collected sensor data. For sampling of the analog signals from the various sensors 340, the processor 320 of this embodiment may include a digital-to-analog converter (DAC). However, those of ordinary skill in the art will recognize that the present invention may be practiced with one or more external DACs in communication between the sensors 340 and the processor 320. In addition, the processor 320 may include internal SRAM and NVRAM. However, those of ordinary skill in the art will recognize that the present invention may be practiced with memory 330 that is only external to the processor 320 as well as in a configuration using no external memory 330 and only memory 330 internal to the processor 320.

The embodiment of FIG. 8 may use battery power as the operational power supply 310. Battery power enables operation without consideration of connection to another power source while in a drilling environment. However, with battery power, power conservation may become a significant consideration in the present invention. As a result, a low power processor 320 and low power memory 330 may enable longer battery life. Similarly, other power conservation techniques may be significant in the present invention. Alternatively, power may be supplied to the data processing module 300 through the communication link 247.

Software running on the processor 320 may be used to manage battery life intelligence and adaptive usage of power consuming resources to conserve power. The battery life intelligence can track the remaining battery life (i.e., charge remaining on the battery) and use this tracking to manage other processes within the system. By way of example, the battery life estimate may be determined by sampling a voltage from the battery, sampling a current from the battery, tracking a history of sampled voltage, tracking a history of sampled current, and combinations thereof.

The battery life estimate may be used in a number of ways. For example, near the end of battery life, the software may reduce sampling frequency of sensors 340, or may be used to cause the power control bus to begin shutting down voltage signals to various components.

This power management can create a graceful, gradual shutdown. For example, perhaps power to the magnetometers is shut down at a certain point of remaining battery life. At another point of battery life, perhaps the accelerometers are shut down. Near the end of battery life, the battery life intelligence can ensure data integrity by making sure improper data is not gathered or stored due to inadequate voltage at the sensors 340, the processor 320, or the memory 330.

Software modules also may be devoted to memory management with respect to data storage. The amount of data stored may be modified with adaptive sampling and data compression techniques. For example, data may be originally stored in an uncompressed form. Later, when memory space becomes limited, the data may be compressed to free up additional memory space. In addition, data may be assigned priorities such that when memory space becomes limited high priority data is preserved and low priority data may be overwritten.

In some embodiments, the data processing module 300 may include no more than a repeater 355. The repeater 355 may get power from the power supply 310 or from the communication link 247. As the communication signal travels within the component via the inter-tool coupling signal 252 and between components 190 via the intra-tool coupling signal 254, signal attenuation and distortion is likely to occur. Some signal transceivers may have less attenuation than others, but loss and distortion may be a problem, particularly for very long drillstrings. As a result, a repeater 355 can be placed at intervals along the communication signal to amplify and re-condition the signal to be clean and strong for further transmission up the drillstring, down the drillstring, or combination thereof.

In still other embodiments, the data processing module 300 may not include the processor 320 and memory 330. Instead, the communicator 350 may couple directly to the sensors 340 and sample the sensor signals prior to transmission on the communication signal.

Figure 10:
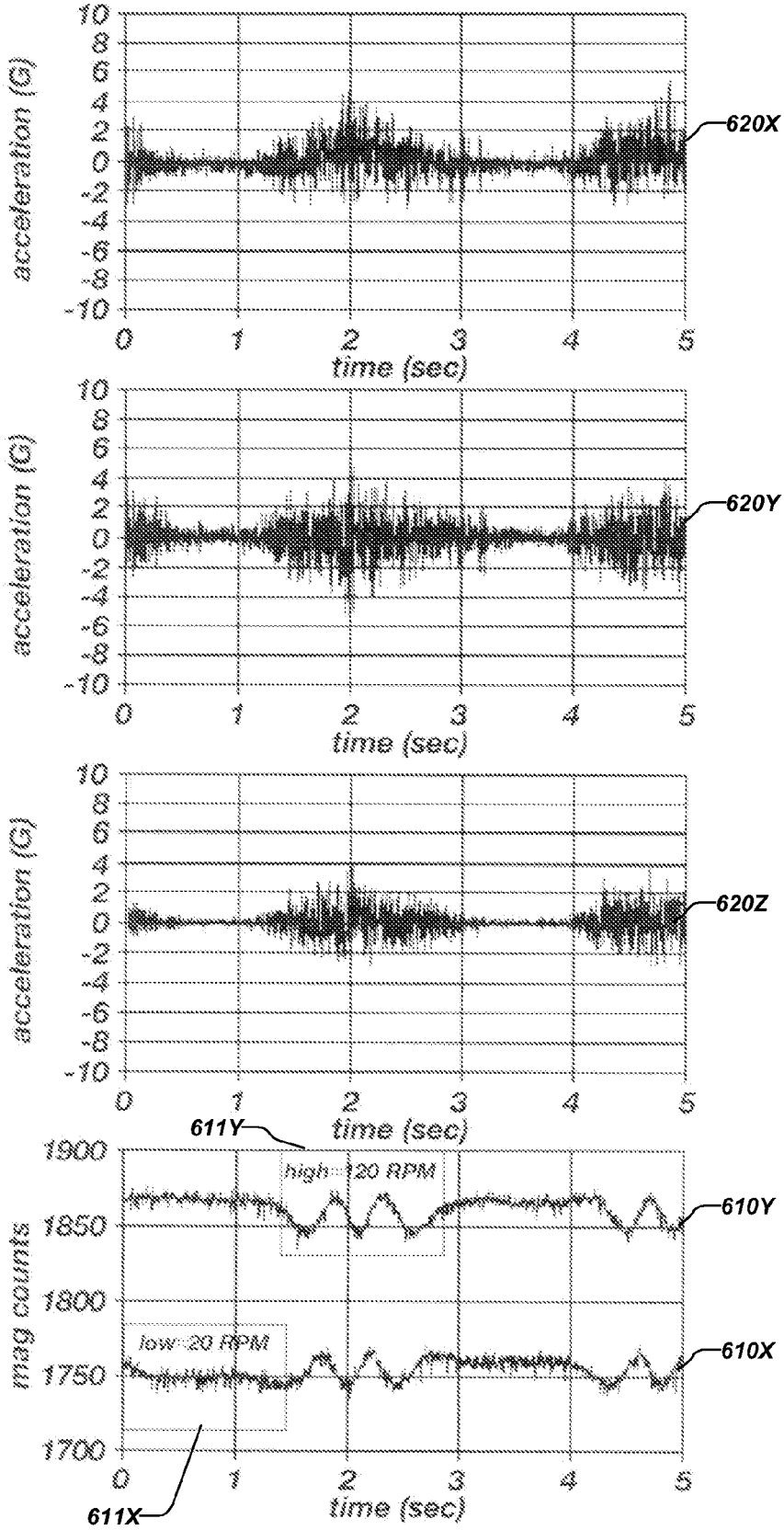
FIG. 10 illustrates examples of data sampled from accelerometer sensors and magnetometer sensors along three axes of a Cartesian coordinate system that is static with respect to the drill bit, but rotating with respect to a stationary observer.

FIG. 10 illustrates examples of data sampled from accelerometer sensors and magnetometer sensors along three axes of a Cartesian coordinate system that is static with respect to the drill bit, but rotating with respect to a stationary observer. In FIG. 10, magnetometer samples histories are shown for X magnetometer samples 610X and Y magnetometer samples 610Y. By tracking the history of these samples, software can detect when a complete revolution has occurred. For example, the software can detect when the X magnetometer samples 610X have become positive (i.e., greater than a selected value) as a starting point of a revolution. The software can then detect when the Y magnetometer samples 610Y have become positive (i.e., greater than a selected value) as an indication that revolutions are occurring. Then, the software can detect the next time the X magnetometer samples 610X become positive, indicating a complete revolution.

FIG. 10 illustrates torsional oscillation as an example of component dynamic behavior that may be of interest. Initially, the magnetometer measurements 610Y and 610X illustrate a rotational speed of about 20 revolutions per minute (RPM) 611X, which may be indicative of the drill bit binding on some type of subterranean formation. The magnetometers then illustrate a large increase in rotational speed, to about 120 RPM 611Y, when the drill bit is freed from the binding force. This increase in rotation is also illustrated by the accelerometer measurements 620X, 620Y, and 620Z.

As stated earlier, time varying data such as that illustrated in FIG. 10 may be analyzed for detection of specific events. These events may be used within the data processing module 300 to modify the behavior of the data processing module 300. By way of example, and not limitation, the events may cause changes such as, modifying power delivery to various elements within the data processing module 300, modifying communications modes, and modifying data collection scenarios. Data collection scenarios may be modified, for example by modifying which sensors 340 to activate or deactivate, the sampling frequency for those sensors 340, compression algorithms for collected data, modifications to the amount of data that is stored in memory 330 on the data processing module 300, changes to data deletion protocols, modification to additional triggering event analysis, and other suitable changes.

Trigger event analysis may be as straightforward as a threshold analysis. However, other more detailed analysis may be performed to develop triggers based on component behavior such as component dynamics analysis, formation analysis, and the like.

Figure 11:
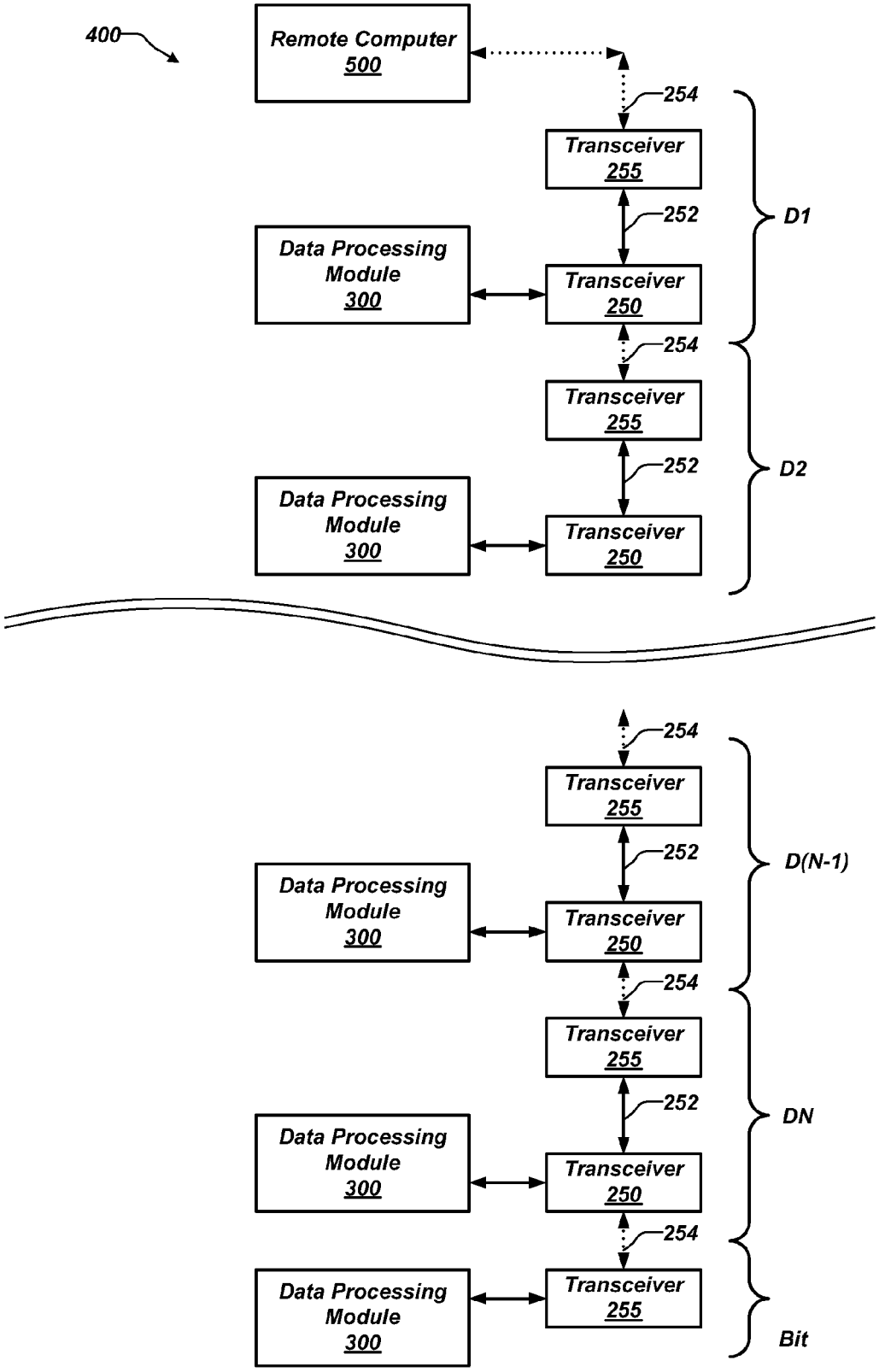
FIG. 11 is a block diagram of a drillstring communication network according to one or more embodiments of the present invention.

FIG. 11 is a block diagram of a drillstring communication network 400 according to one or more embodiments of the present invention. The communication network includes a remote computer 500, a first downhole module D1, a second downhole module D2, a bit, a last downhole module DN, and a penultimate downhole module D(N-1). Each downhole module represents an embodiment of an electronics module 290 that may be placed in a pin-end 210 of a component. Of course, there may be many more downhole modules along the communication network. In addition, each component need not include a downhole module. Thus, while not illustrated, many components 190 may simply include the first signal transceiver 250 and the second signal transceiver 255 for making the drillstring communication network 400 continuous. Thus each component that participates in the downhole communications network includes a first signal transceiver 250 coupled to a second signal transceiver 255 via an intertool coupling signal 252. Between each of the components 190 participating in the downhole communications network is an intra-tool coupling signal 254.

Some, or all, of the components 190 may include an electronics module 290 coupled to the second signal transceiver 255. As explained earlier, the electronics module 290 may include only a repeater 355. Alternatively, the electronics module 290 may include a variety of components such as processors 320, sensors 340, a repeater 355, and combinations thereof.

The downhole modules may be disposed at regular intervals along the drillstring communication network 400 or may be concentrated at certain areas of the drillstring that are of particular interest. In addition, the drillstring communication network 400 need not traverse the entire drillstring. As a non-limiting example, the drillstring communication network 400 may extend from the remote computer 500 on the surface only down to a stabilizer or motor sub. As another non-limiting example, the drillstring communication network 400 may extend from the drill bit up to an electronics module 290 only part way up the drillstring. In this type of network, some of the electronics modules 290 may include large amounts of memory 330 for storing historical information from the drill bit or other electronics modules 290 in the network.

Figure 12:
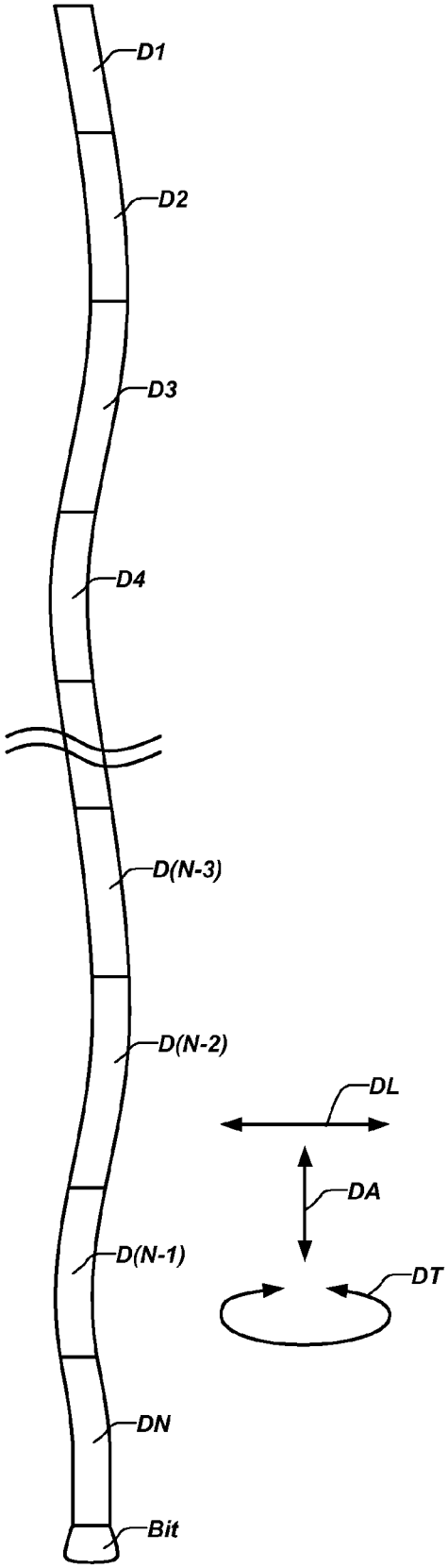
FIG. 12 is a simplified view of a drillstring including embodiments of the present invention and illustrating potential dynamic movement of the drillstring.

FIG. 12 is a simplified view of a drillstring including embodiments of the present invention and illustrating potential dynamic movement of the drillstring. The drillstring includes components D1, D2, D3, D4, D(N-3), D(N-2), D(N-1), DN, and a drill bit. In general, the drillstring may experience undesired motion in a lateral direction (DL), an axial direction (DA) and a torsional direction (DT). Mechanical systems that experience displacement due to forces, particularly periodic forces, such as drillstring rotation, may experience vibrations in any of these directions as well as combinations of these directions. In some cases, these vibrations can occur at a natural harmonic of the mechanical system (i.e., the drillstring) and cause large, undesired forces and displacements on elements of the drillstring. In embodiments of the present invention, data processing modules 300 distributed along the drillstring can sample accelerations, and determine velocities and displacements at each of the locations where a data processing module 300 is disposed. When combined and analyzed together with the mechanical characteristics of the drillstring, harmonic vibrations can be detected. In response, if a harmonic vibration is severe, an operator may modify the drilling characteristics by, for example, modifying the weight-on-bit or the rotational speed.

In addition, motion characteristics may be inferred at locations along the drillstring different from where the electronics modules 290 are located. As a non-limiting example, interpolation of the motion characteristics at two different electronics modules 290 may be used to determine motion characteristics at points along the drillstring between the two electronics modules 290. As another non-limiting example, extrapolation of the motion characteristics at two different electronics modules 290 may be used to determine motion characteristics at points along the drillstring that are outside the two electronics modules 290.

To analyze the dynamic movement characteristics of the drillstring as a whole, the acceleration measurements, velocity determinations, and displacement determinations at each of the data processing module 300 locations must be synchronized with respect to each other so that the data at each location can be correlated to the same time.

Time synchronization of the distributed data-acquisition/sensor packages may be accomplished in a pair-wise fashion using an algorithm used for networks, e.g., TPSN (time synchronization for sensor networks) or TDMA (time division multiple access). In the case of TPSN, the objective is to discover a propagation time and a clock drift between two sensors. Propagation time and clock drift may be represented as:

$$\text{Propagation}=(\text{delta}T1\text{-}2+\text{delta}T2\text{-}1)/2$$

$$\text{clock drift}=(\text{delta}T1\text{-}2-\text{delta}T2\text{-}1)/2$$

Where deltaT1-2 is the total transit time (propagation time+clock drift) from unit 1 to unit 2 and deltaT2-1 is the total transit time from unit 2 to unit 1.

In addition, this pair-wise check may be performed periodically during the run to maintain synchronization, which may vary due to clock drift.

In the communication network described herein, there may be significant latency between when a signal starts at one point of the drillstring and when it reaches the farthest data processing module 300. This latency may be caused by the intra-tool coupling signal 254 links, repeaters 355, and even the inter-tool coupling signal 252 distances that must be traveled. As a result, merely sending a start time down the communication signal as a synchronization point will not be effective because it may be difficult, or impossible to determine the latency at each point where a data processing module 300 resides.

Figure 13:
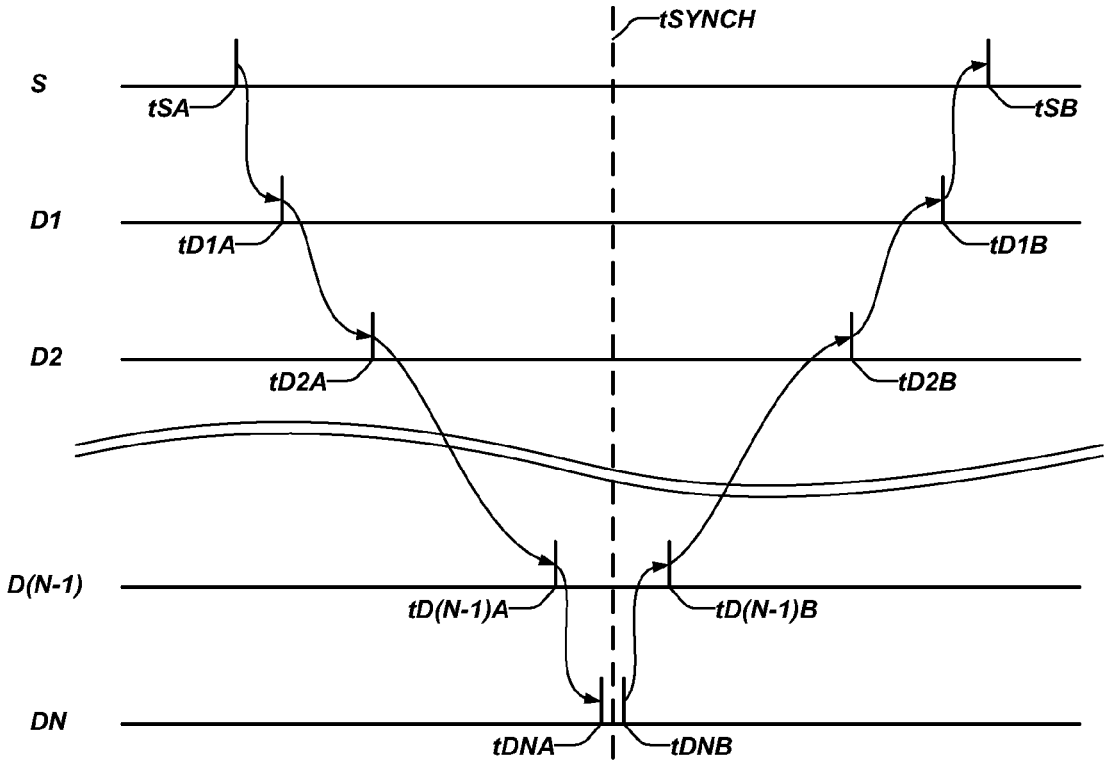
FIG. 13 illustrates a timeline indicating a synchronizing signal at various locations along the drillstring.

FIG. 13 illustrates a method of determining a synchronization time that is substantially the same at any point along the drillstring. A timeline indicating a synchronizing signal at various locations along the drillstring is shown in FIG. 13. In FIG. 13, a time line is illustrated for the surface S with the remote computer 500, a data processing module D1 at a first location on the drillstring, a data processing module D2 at a second location on the drillstring, a data processing module D(N-1) at a penultimate location on the drillstring, and a data processing module DN at a last location on the drillstring. To begin a synchronization process, the remote computer 500 sends a forward synchronization signal tSA down the communication signal. At a time delay later, the forward synchronization signal tD1A arrives at data processing module D1. At a time delay later, the forward synchronization signal tD2A arrives at data processing module D2. At a time delay later, the forward synchronization signal tD(N-1)A arrives at data processing module D(N-1). At a time delay later, the forward synchronization signal tDNA arrives at data processing module DN.

The last data processing module DN receives the forward synchronization signal and responds by sending a return synchronization signal tDNB back up the drillstring. At a time delay later, the return synchronization signal tD(N-1)B arrives at data processing module D(N-1). At a time delay later, the return synchronization signal tD2B arrives at data processing module D2. At a time delay later, the return synchronization signal tD1B arrives at data processing module D1. At a time delay later, the return synchronization signal tSB arrives at the remote computer 500.

Each data processing module along the drillstring may begin collecting accelerometer data when it receives its forward synchronization signal tXA and for a predetermined time period thereafter. A synchronization time tSYNCH may be determined by the remote computer 500 based on the forward synchronization signal tSA and the return synchronization signal tSB. This determination may be as simple as one-half the difference between the forward synchronization signal tSA and the return synchronization signal tSB. However, in some cases, latency for signals in the forward direction may be different from latency for signals in the return direction. This difference may be taken into account in the determination of the synchronization time tSYNCH.

Each of the data processing modules 300 may determine the synchronization time tSYNCH in a similar manner based on its forward synchronization signal tXA and its return synchronization signal tXB. With the synchronization time tSYNCH determined, the data processing module 300 may delete the accelerometer data collected between its forward synchronization signal tXA and the synchronization time tSYNCH. Thus, the accelerometer data at each data processing module 300 begins at the same time. With this fixed starting point at each of the data processing modules 200, correlated velocity and displacement determinations may be made by each data processing module 300. The information for acceleration, velocity, and displacement may be transferred from each data processing module 300 to the remote computer 500 for further processing, such as, for example, harmonic vibration analysis.

In another processing model, each data processing module 300 may send its acceleration information to the remote computer 500 from its forward synchronization signal tXA time, along with the time difference between the forward synchronization signal tXA and the return synchronization signal tXB. The remote computer 500 can then strip off accelerometer information for each data processing module 300 between the forward synchronization signal tXA and the synchronization time tSYNCH. The remote computer 500 can then determine correlated velocity and displacement information for each data processing module 300 and perform harmonic vibration analysis on the drillstring.

This synchronization time tSYNCH process has been described relative to a remote computer 500 on the surface generating the initial forward synchronization signal tSA and receiving the final return synchronization signal tSB. However, the forward synchronization signal tXA may be initiated by one of the data processing modules 300. In addition, the forward direction may be defined as from the drill bit toward the surface, rather than from the surface toward the drill bit. Thus, if the entire drillstring is participating in the communication network, the drill bit may initiate the forward synchronization signal tXA and the remote computer 500 may generate the return synchronization signal tXB.

As another example of a synchronization mechanism, a model may be developed of the drill string relative to characteristics of the various drillstring components. Some non-limiting examples of characteristics that may be modeled are length of the components, material, torsional stiffness, axial stiffness and lateral stiffness.

In addition, a synchronization signal may be propagated along the drill string using methods other than an electronic signal. As a non-limiting example, the synchronization signal may be a mud pulse that is detectable by each of the electronics modules 290. As another non-limiting example, the synchronization signal may be an acceleration event that is propagated along the drillstring. Non-limiting examples of such acceleration events are a sonic pulse that is directed along the drillstring or a drilling event (e.g., the drill bit hitting the bottom of the hole) that will propagate along the drillstring.

Using the model of the drillstring, propagation times of these synchronization signals may be determined quite accurately such that each electronics module 290 may be able to determine a synchronization time in response to an arrival time of the synchronization pulse and an analysis of the drillstring model.

While the present invention has been described herein with respect to certain preferred embodiments, those of ordinary skill in the art will recognize and appreciate that it is not so limited. Rather, many additions, deletions, and modifications to the preferred embodiments may be made without departing from the scope of the invention as hereinafter claimed. In addition, features from one embodiment may be combined with features of another embodiment while still being encompassed within the scope of the invention as contemplated by the inventors.

What is claimed is:

1. A component configured for attachment as part of a drillstring for subterranean drilling, comprising:

a tubular member comprising a central bore formed therethrough;

a box-end at a first end of the tubular member, the box-end comprising a first signal transceiver;

a pin-end at a second end of the tubular member, the pin-end adapted for coupling to a box-end of another component and comprising a second signal transceiver operably coupled to the first signal transceiver via an electrical pathway and configured for communication with the first signal transceiver in the other component; and an end-cap configured for disposition in the central bore of the pin-end to form an annular chamber between a side of the end-cap and a wall of the central bore of the pin-end when the end-cap is disposed in the central bore of the pin-end, wherein the tubular member includes a connection pathway configured to couple the electrical pathway to a contact point at the end-cap when the end-cap is disposed within the central bore.

2. The component of claim 1, further comprising an electronics module configured for disposition in the annular chamber, the electronics module comprising:

at least one sensor configured for sensing at least one physical parameter;

a communication element operably coupled to the at least one sensor and configured for operable coupling to the second signal transceiver when the electronics module is disposed in the annular chamber; and the contact point configured to connect to the connection pathway when the electronics module is disposed in the annular chamber.

3. The component of claim 2, wherein the electronics module further comprises:

a memory configured for storing information comprising computer instructions and sensor data; and a processor operably coupled to the memory and the communication element and configured for executing the computer instructions, wherein the computer instructions are configured for processing the sensor data from the at least one sensor and delivering the sensor data, the processed sensor data, or combination thereof to the communication element for transmission to the other component via the second signal transceiver.

4. The component of claim 1, further comprising an electronics module configured for disposition in the annular chamber and including a repeater configured for operable coupling to the second signal transceiver when the electronics module is disposed in the annular chamber and further configured for amplifying a signal on the second signal transceiver.

5. The component of claim 1, wherein the end-cap comprises:

an end-cap body;

a first flange extending radially from a proximal end of the end-cap body; and a second flange extending radially from a distal end of the end-cap body;

wherein the first flange, the second flange, the end-cap body, and the wall of the central bore of the pin-end form the annular chamber.

6. A drillstring communication network, comprising:

a plurality of components coupled together, each component comprising:

a box-end at a first end of the component bearing a first signal transceiver; and a pin-end at a second end of the component bearing a second signal transceiver operably coupled to the first signal transceiver; and an electrical pathway operably coupling the first signal transceiver and the second transceiver, the electrical pathway including a connection pathway extending to a bore of the pin-end;

at least one component of the plurality of components further comprising:

an end-cap disposed in a central bore of the pin-end forming an annular chamber between a side of the end-cap and a wall of the central bore of the pin-end, and an electronics module disposed in the annular chamber, the electronics module comprising at least one sensor, a communication element operably coupled between the at least one sensor and the second signal transceiver, and a contact point configured to connect the electronics module to the connection pathway when the electronics module is disposed in the annular chamber, and a remote computer configured for communicating with the at least one component;

wherein the first signal transceiver of each component and the second signal transceiver of each component are configured for communication therebetween such that the plurality of components form a communication link between the communication element of the at least one component and the remote computer.

7. The drillstring communication network of claim 6, wherein the electronics module further comprises:

a memory configured for storing information comprising computer instructions and sensor data; and a processor operably coupled to the memory and the communication element and configured for executing the computer instructions, wherein the computer instructions are configured for processing the sensor data from the at least one sensor and delivering the sensor data, the processed sensor data, or combination thereof to the communication element for transmission to the other component via the second signal transceiver.

8. The drillstring communication network of claim 6, wherein the electronics module further comprises a repeater configured for operable coupling to the second signal transceiver when the electronics module is disposed in the annular chamber and further configured for amplifying a signal on the second signal transceiver.

9. The drillstring communication network of claim 6, wherein at least one of the components includes a second electronics module including a repeater configured for operable coupling to the second signal transceiver when the second electronics module is disposed in the annular chamber and further configured for amplifying a signal on the second signal transceiver.

10. A drillstring-dynamics analysis network, comprising:

a communication signal operably coupling a plurality of components through an inter-tool coupling signal within each of the plurality of components and an intra-tool coupling signal between each two adjacent components of the plurality; and a plurality of data processing modules disposed in at least some of the plurality of components, each data processing module comprising:

a plurality of accelerometers configured for sensing acceleration in a plurality of directions at the data processing module; and a communication element operably coupled to the plurality of accelerometers and the communication signal;

wherein each data processing module is configured to collect accelerometer information and transmit the accelerometer information to the communication element in another data processing module, a remote computer, or a combination thereof;

wherein at least one data processing module is configured to process the accelerometer information to determine velocity and displacement characteristics at a location along the drillstring.

11. The drillstring-dynamics analysis network of claim 10, wherein the accelerometer information includes acceleration in at least one direction selected from the group consisting of tangentially relative to a drillstring centerline, radially relative to the drillstring centerline, axially relative to the drillstring centerline, and combinations thereof.

12. The drillstring-dynamics analysis network of claim 10, wherein the at least one data processing module further comprises an element selected from the group consisting of: (i) the remote computer, (ii) a processor disposed in a drill bit, and (iii) one of the plurality of data processing modules disposed in an annular chamber of a pin-end of one of the plurality of components.

13. The drillstring-dynamics analysis network of claim 12, wherein the at least one data processing module is further configured to process the accelerometer information to determine a resonant vibration in the drillstring proximate at least one location along the drillstring.

14. The drillstring-dynamics analysis network of claim 10, wherein the at least one data processing module is further configured to determine motion characteristics at a location along the drillstring between at least two of the data processing modules or a location along the drillstring beyond at least two of the data processing modules by inferring the motion characteristics relative to motion characteristics at at least two of the data processing modules.

15. The drillstring-dynamics analysis network of claim 10, wherein each of the plurality of data processing modules is configured for:

detecting a forward synchronization signal and a return synchronization signal on the communication signal at each of the plurality of data processing modules; and determining a synchronization time that is substantially the same at each of the plurality of data processing modules by analyzing a difference between arrival times of the forward synchronization signal and the return synchronization signal.

16. The drillstring-dynamics analysis network of claim 10, further comprising:

a model of the plurality of components for determining drillstring characteristics;

wherein each of the plurality of data processing modules is configured for:

detecting a synchronization signal at each of the plurality of data processing modules; and determining a synchronization time that is substantially the same at each of the plurality of data processing modules by analyzing an arrival time of the synchronization signal and adjusting the synchronization time at one or more of the data processing modules responsive to an analysis of the drillstring characteristics.

17. The drillstring-dynamics analysis network of claim 16, wherein the synchronization signal comprises a determinable acceleration event selected from the group consisting of operation of the drillstring and a sonic pulse induced in the drillstring.

18. The drillstring-dynamics analysis network of claim 16, wherein the synchronization signal comprises a mud pulse.

19. A method of communicating information in a drillstring, comprising:

communicatively coupling a plurality of components bearing a first transceiver at a box-end and a second transceiver at a pin-end by mechanically coupling the plurality of components to form a communication signal spanning the plurality of components;

disposing an electronics module in an annular chamber in the pin-end of at least one of the plurality of components to operably couple the electronics module to the communication signal via a contact point of the electronics module when the electronics module is disposed in the annular chamber;

sensing at least one physical parameter near the electronics modules; and communicating the at least one physical parameter, via the communication signal, to another electronics module in another component, a remote computer, or a combination thereof.

20. The method of claim 19, further comprising executing computer instructions with a processor on the electronics module to process sensor data corresponding to the at least one physical parameter and communicate the sensor data, the processed sensor data, or a combination thereof to the other component, the remote computer, or a combination thereof.

21. The method of claim 19, further comprising repeating and amplifying the communication signal with the electronics module.

22. The method of claim 19, wherein sensing the at least one physical parameter comprises sensing acceleration in at least one direction selected from the group consisting of tangentially relative to a drillstring centerline, radially relative to the drillstring centerline, axially relative to the drillstring centerline, and combinations thereof.

23. A method of determining dynamics characteristics of a drillstring, comprising:

acquiring accelerometer information at a plurality of locations along a drillstring, wherein the acquiring comprises sampling a plurality of accelerometers disposed in a pin-end of a plurality of components operably coupled together to form the drillstring;

communicating the accelerometer information along the drillstring using communication capabilities of each component in the drillstring; and processing the accelerometer information from the plurality of locations to determine drillstring velocity and displacement characteristics at the plurality of locations along the drillstring.

24. The method of claim 23, wherein processing the accelerometer information comprises determining accelerations in one or more directions selected from the group consisting of an axial direction, a radial direction and a rotational direction.

25. The method of claim 23, wherein processing the accelerometer information comprises determining a resonant vibration in the drillstring proximate at least one of the plurality of locations.

26. The method of claim 23, wherein processing the accelerometer information is performed at an element selected from the group consisting of a remote computer, a processor disposed in a drill bit, and a processor on an electronics module disposed in an annular chamber of the pin-end of a component of the plurality of components.

27. The method of claim 23, wherein processing the accelerometer information further comprises:

detecting a forward synchronization signal and a return synchronization signal at each of the plurality of locations; and determining a synchronization time that is substantially the same at each of the plurality of locations along the drillstring by analyzing a difference between arrival times of the forward synchronization signal and the return synchronization signal.

28. The method of claim 27, further comprising:

determining a propagation time between any two of the plurality of locations; and determining a clock drift between the any two of the plurality of locations.

* * * * *